US005827941A

United States Patent [19]

Good et al.

[11] Patent Number: 5,827,941

[45] Date of Patent: Oct. 27, 1998

[54] FLOW-CONTROLLED CALIBRATION SYRINGE

[75] Inventors: Fred Good, Westminster; Carl Zimmer, Boulder, both of Colo.

[73] Assignee: Pulmonary Data Service Instrumentation, Inc., Louisville, Colo.

[21] Appl. No.: 965,498

[22] Filed: Nov. 6, 1997

Related U.S. Application Data

[63] Continuation of Ser. No. 645,038, May 6, 1996, abandoned, which is a continuation of Ser. No. 353,703, Dec. 12, 1994, abandoned.

[51] Int. Cl.[6] ..... F04B 21/02

[52] U.S. Cl. ..... 73/1.19; 417/566

[58] Field of Search ..... 73/3, 1.19; 417/437, 417/442, 559, 560, 566

[56] References Cited

U.S. PATENT DOCUMENTS

| | | | |
|---|---|---|---|
| 12,413 | 2/1855 | Hammer | 417/560 |
| 2,986,098 | 5/1961 | Trout et al. | 417/566 |
| 3,314,600 | 4/1967 | Hadley | 417/566 |
| 3,664,774 | 5/1972 | Tupper et al. | 417/560 |
| 4,030,495 | 6/1977 | Virag | 417/566 |
| 4,324,127 | 4/1982 | Gazzara et al. | 73/3 |
| 5,076,093 | 12/1991 | Jones, Jr. et al. | 73/3 |

FOREIGN PATENT DOCUMENTS

| | | | |
|---|---|---|---|
| 2032522 | 5/1980 | United Kingdom | 417/442 |

*Primary Examiner*—Robert Raevis
*Attorney, Agent, or Firm*—Sheridan Ross P.C.

[57] ABSTRACT

A calibration syringe is constructed like a single stage manual pump having a plunger. The input manifold has a duckbill valve that functions to maintain a fixed air flow rate through the syringe even with variable forces acting on the plunger. The duckbill valve has a pair of flexible lips which face upstream against the air flow. As a vacuum is formed inside the pump's input chamber, ambient air pressure closes the flexible lips. Thus, variable plunger forces creates a variable orifice inversely proportional to the plunger force. The result is a constant flow rate syringe.

39 Claims, 8 Drawing Sheets

FLOW-CONTROLLED CALIBRATION SYRINGE

This is a continuation of application Ser. No. 08/645,038, filed on May 6, 1996, now abandoned, which is a continuation of Ser. No. 08/353,703, filed Dec. 12, 1994, now abandoned.

CROSS REFERENCE PATENTS

U.S. application Ser. No. 08/110,549 filed Aug. 23, 1993 is incorporated herein by reference.

FIELD OF INVENTION

The present invention relates to an improved apparatus for calibrating lung testing instruments.

BACKGROUND OF THE INVENTION

Historically lung testing instruments such as spirometers were calibrated by air volume tests. For example, if three liters of air could be injected into the spirometer and this volume accurately sensed, then the spirometer was deemed in calibration.

Recently, the American Thoracic Society (ATS) and the Social Security Administration (SSA) mandated the calibration of spirometers by injecting the three liters of air at specific flow rates. The reason was that an instrument would not provide an accurate analysis of the medical condition of a human lung unless it could measure precise variables in the flow rate per unit time of the human lung.

Presently volumetric calibration syringes are available which are simple hand pumps much like a bicycle pump. The problem with these currently available hand pumps is that each operator exerts a different force on the pump handle. A 250 pound pump operator might evacuate the entire 3 liter contents of the pump in three seconds. A 98 pound pump operator might evacuate the entire pump chamber in six seconds. Therefore, the flow rate of the calibrating syringes is highly variable. Furthermore, minor jams and sticking of the central pump shaft results in further variations of the flow rate from conventional hand pumps.

Ideally ATS and SSA specs call for the production of a constant one-half liter per second air flow rate from a calibrating syringe. Other required flow rates include one and three liters per second. Conventional apparatus now utilizes gross time estimates to attempt to evacuate a three liter syringe in six seconds for the half liter test. However, the operator error and sticking of the central pump shaft prevent a constant output flow rate from being achieved.

The preferred embodiment of the present invention uses a unique flow regulating valve in the syringe body to produce a constant output flow even with varying forces on the central pump shaft. The unique flow regulating valve has a flexible duck bill design. Collapsing flexible walls create a variable orifice size. In operation the harder the operator pushes the central pump shaft, the smaller the orifice size becomes. The result is a constant flow rate of the chosen flow rate such as one-half liter per second with widely varying forces on the central pump shaft.

SUMMARY OF THE INVENTION

The main object of the present invention is to provide a calibration syringe having a constant output flow rate with varying forces on the plunger.

Another object of the present invention is to provide a plurality of selectable flow regulator valves in the housing of a calibration syringe, thus enabling flow rates of ½, 1, 3 liters per second or other flow rates.

Other objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 3:
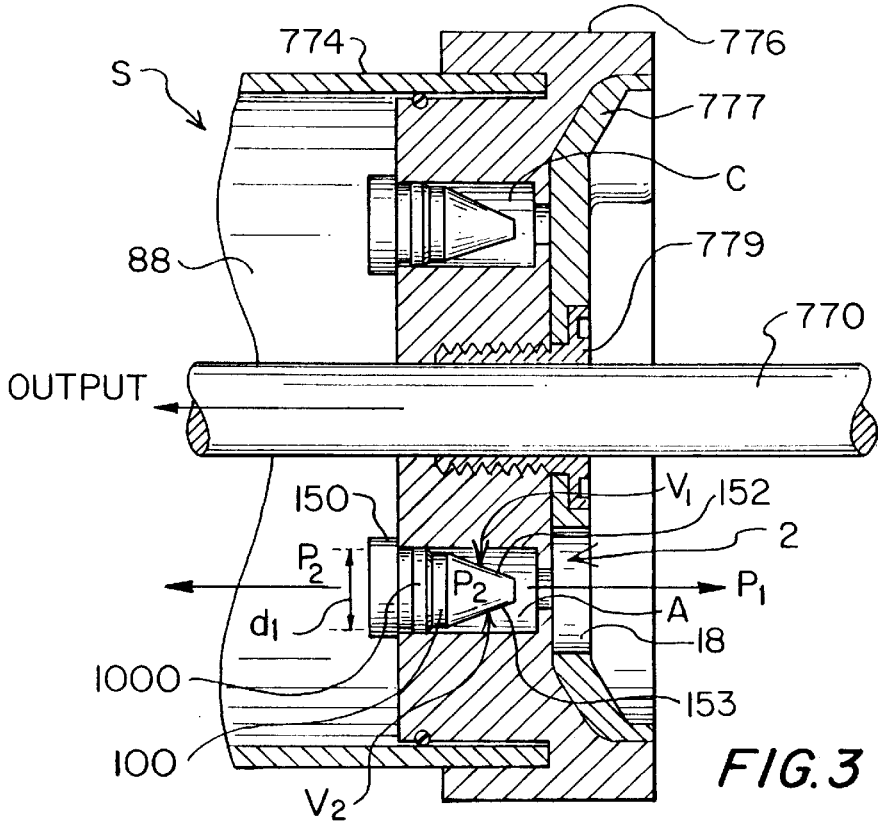
FIG. 3 is a longitudinal sectional view taken along line 3—3 of FIG. 2.

Referring first to FIG. 3, ambient air flows through inlet 2 of port 18 due to the pressure drop at $P_2$ which is caused by the motion of plunger 770 in direction OUTPUT. Ambient air flows into the syringe chamber 88 between valve lips 152, 153. $P_2$ is now lower than $P_1$. This causes force vectors $V_1$, $V_2$ to close valve lips 152, 153. The Venturi effect also adds to vectors $V_1$, $V_2$. Thus, $P_2$ drops due to the vacuum created in syringe chamber 88 and the Venturi effect.

The lips 152, 153 are flexible. They are preferably made of any flexible resilient material such as rubber, plastic, silicon, neoprene, nitrite, fluorocarbon, vinyl, propylene, butyl, or other compounds. The flexible regulator valve 1000 is constructed to maintain a fixed diameter $d_1$, at flex point 100 during all flow conditions. Only the lips 152, 153 are flexible under pressure drops between $P_1$ and $P_2$. Mounting support 150 secures the flexible valve 1000 inside port 18.

Figure 7:
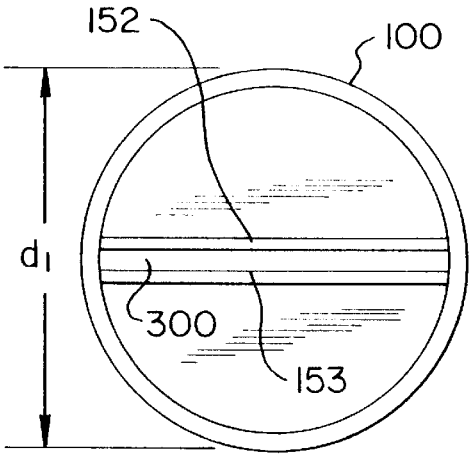
FIG. 7 is a front plan view of an alternate embodiment of the regulator valve with the orifice in the open position.

Referring next to FIG. 7, the vacuum in syringe chamber 88 is very weak. Thus, the orifice 300 between lips 152, 153 is at its maximum size.

Figure 8:
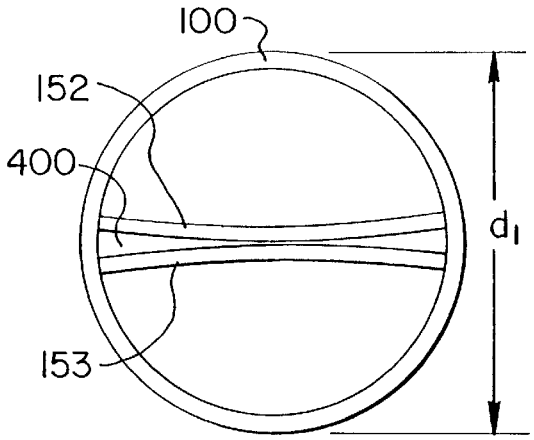
FIG. 8 is the same as FIG. 7 with the orifice in the partially closed position.

In FIG. 8, the syringe operator has initiated a medium strength force on plunger 770. $P_2$ has dropped below $P_1$. Lips 152, 153 have been forced together forming a smaller orifice 400. Thus, the output flow from the syringe has remained constant due to the higher speed air through the smaller orifice 400.

Figure 9:
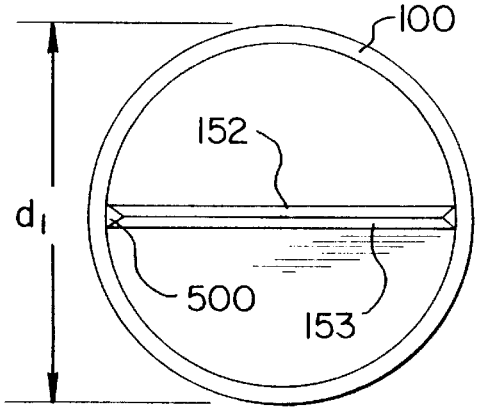
FIG. 9 is the same as FIG. 7 with the orifice in the closed position.

Finally, in FIG. 9, the syringe operator has initiated a strong force on plunger 770. The pressure drop of $P_2$ has practically closed off orifice 500. The output flow rate remains constant. In all instances the ambient air input flow rate into the syringe is the same as the syringe output.

The exact distortion of lips 152, 153 depends on numerous variables including plunger 770 force, fluid (air) density, and ambient pressure differentials between $P_1$ and $P_2$. Variable flow compensations can be achieved by various types of lips 152, 153, the length to width ratio of the orifice 300, the wall angles and length, as well as the material properties. The syringe's output flow rate and orifice closure can be controlled in any desired way for various pressure differences, not necessarily to a constant value. It is, therefore, possible to design the lips 152, 153 in such a manner as to create a customized relationship between the syringe's throughput and the force on the plunger. But, in all the embodiments shown herein the lips have been designed to produce a constant flow rate at either ½, 1, or 3 liters per second.

MATHEMATICAL DISCUSSION

Valve Element Restoring Force

Figure 10:
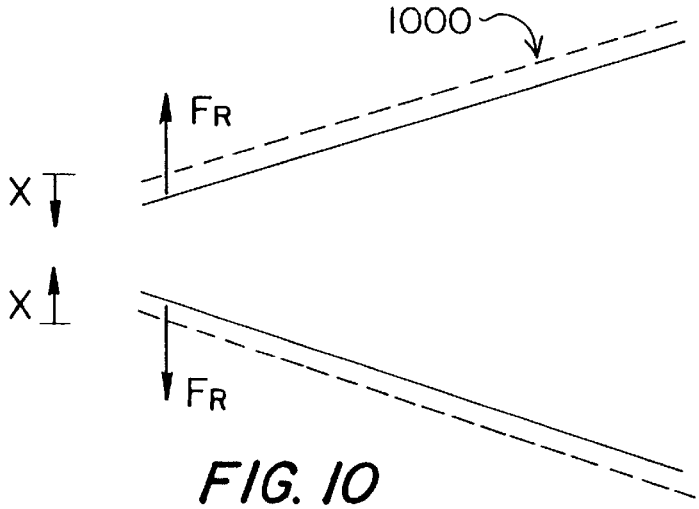
FIG. 10 is a diagram of the flexible valve with dashed lines representing the equilibrium position, and the solid lines representing the compressed position.

If the valve body 1000 in FIG. 10 is deformed then there is a "restoring" force $F_R$ that acts to restore the valve to the original shape. In FIG. 10, the dashed lines represent the equilibrium position of the valve, solid lines represent the compressed position.

The restoring force $F_R$ is proportional to and acts in a direction opposite that of the deflection x.

$$F_R = K_1 x$$

Figure 11:
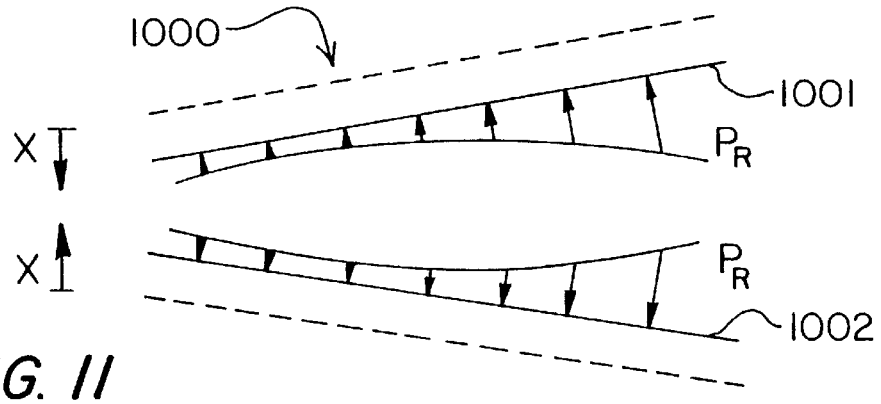
FIG. 11 is a diagram of the restoring pressure $P_R$ acting on the flexible valve.

The value of the proportionality constant $K_1$ depends on the geometric and material parameters of the valve. $F_R$ is shown above acting on a single pair of points of the valve. However, it would be distributed along the surface as shown in FIG. 11. In general, when a force is distributed over a surface it is referred to as a pressure. The restoring $P_R$ can be variable over the surface. The exact shape of the distribution depends on the geometric and material parameters of the valve 1000.

Pressure Driven Flow

Figure 12:
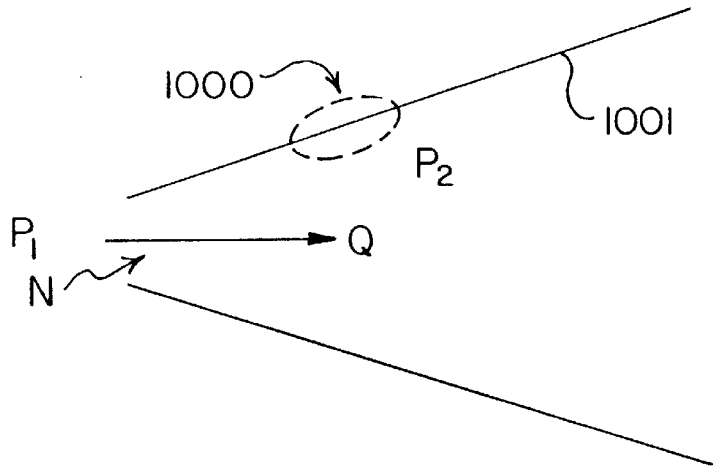
FIG. 12 is a diagram of the flexible valve showing flow direction and the nozzle area.

A situation is now analyzed where a pressure drop is imposed across the valve. If a pressure drop is imposed across the valve $P_2 > P_1$ then a flow Q will result. This is shown in FIG. 12.

Figure 13:
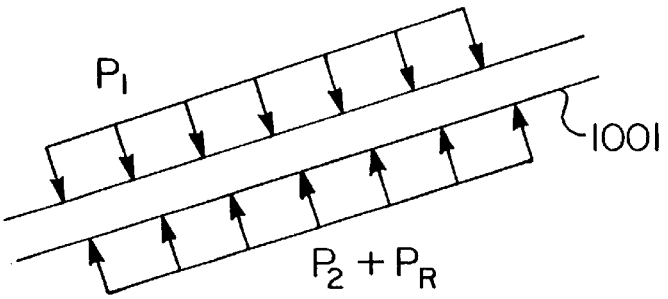
FIG. 13 is a diagram of the enlarged portion 1000 of FIG. 12 showing the force balance.

The force balance on the valve surface is shown in FIG. 13. The forces acting on the valve surface must be in equilibrium (because the valve is not in motion). Acting on the inner surface is the pressure $P_2$. Acting on the outer surface is pressure $P_1$. An additional pressure term is required to balance the difference between $P_2$ and $P_1$. This pressure term is the restoring pressure PR (noted above) that accompanies a deformation of the valve. The valve nozzle N (defined as the point of minimum cross section area) will, therefore, decrease in size if $P_2 < P_1$. There will be a slight variation in pressure along the cross section due to the Bernoulli effect (venturi effect). This variation is slight. The new force balance is shown in FIG. 13.

Flow Equation

Figure 14:
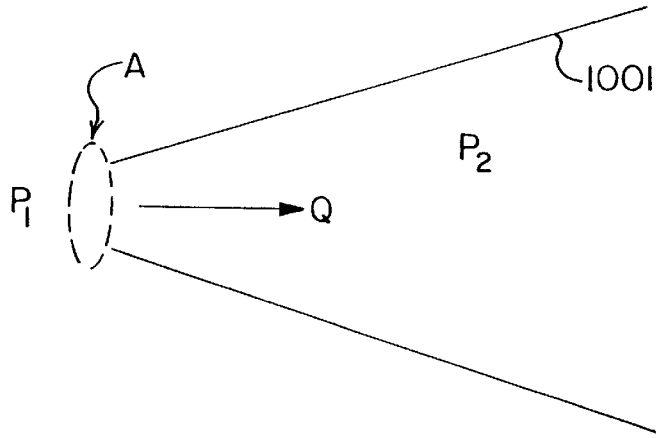
FIG. 14 is a diagram showing the nozzle area A of the regulator valve.
Figure 15:
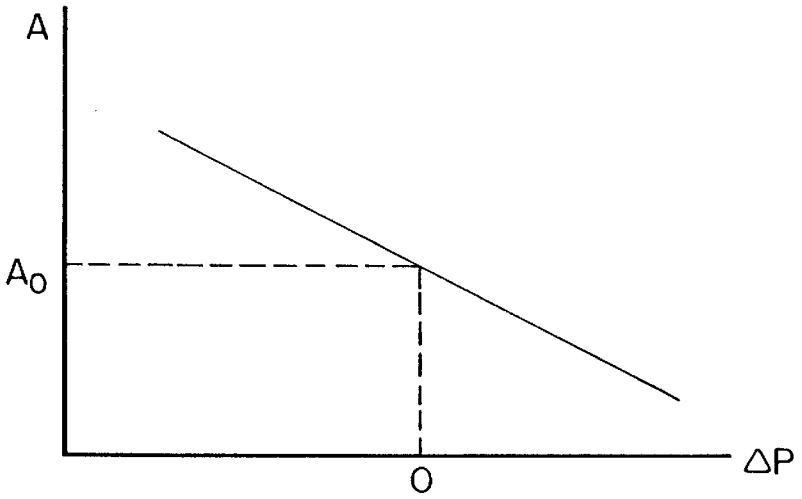
FIG. 15 is a chart showing the relationship area A to pressure drop.

The valve nozzle area A varies depending on pressure drop $\Delta P = P_1 - P_2$. This relationship is shown in FIGS. 14, 15. The shape of the line (or curve) C will depend on the geometric and material parameters of the valve. The important thing to note is that the area A increases with decreasing values of ΔP, and vice versa. The relationship can be expressed mathematically as:

$$A = A_O - K_2 \Delta P$$

The term $A_O$ is the area corresponding to ΔP=O. The flow rate Q through the nozzle area A of FIG. 14 will depend on the area A and the pressure drop $\Delta P = P_1 - P_2$:

$$Q = K_3 A \sqrt{\Delta P}$$

The flow rate Q is therefore:

$$Q = K_3 A_0 \sqrt{\Delta P} - K_3 K_2 \Delta P$$

Figure 16:
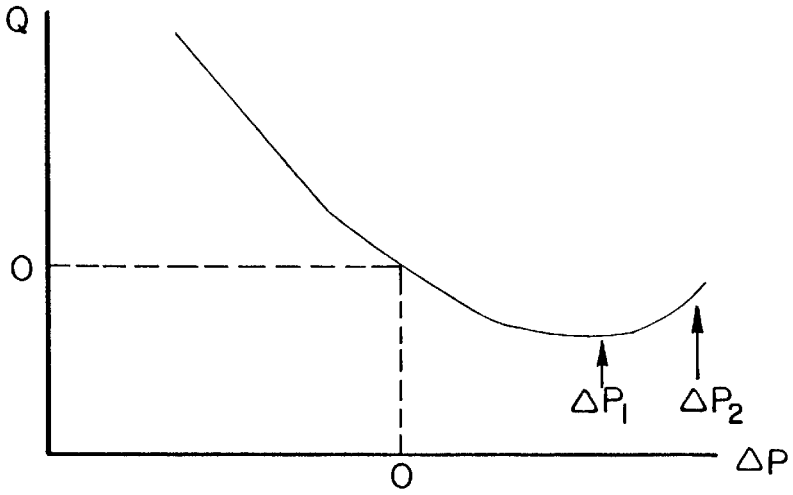
FIG. 16 is a chart showing the relationship of flow rate to pressure drop.

The values of the proportionality constants $K_2$ and $K_3$, depend on the geometric and material properties of the valve. The equation above is plotted in FIG. 16.

While the shape of the curve will depend on the geometric and material properties of the valve, there are two important things to note:

1. In the syringe applications shown in FIG. 1 the following is a description of FIG. 16:
   Starting with ΔP=0 the flow rate Q initially increases with increasing values of ΔP. Increasing ΔP beyond $\Delta P_1$, is accompanied by a decrease in the flow rate Q. At a high enough value of ΔP ($\Delta P_2$) the flow rate will be zero.
2. For other applications ΔP<0 ($P_2 > P_1$):
   Starts with ΔP=0 the flow rate in the opposite direction of Q will increase "rapidly" with increasing values of ΔP. This rate of change is much larger than observed with the area because of the ΔP term in the flow equation.

The valve must be configured such that P1 is atmospheric and P2 is the pressure within the syringe chamber. When the plunger is forced in the OUTPUT direction the observed condition is $P_2$, $P_1$ (ΔP,0). If the magnitude of ΔP exceeds $\Delta P_1$, then the amount of air entering the syringe through the valve decreases.

It is understood that the placement of the above described valve in a syringe could be either in the inlet or the outlet portion thereof.

Figures 1, 4, 5, 6:
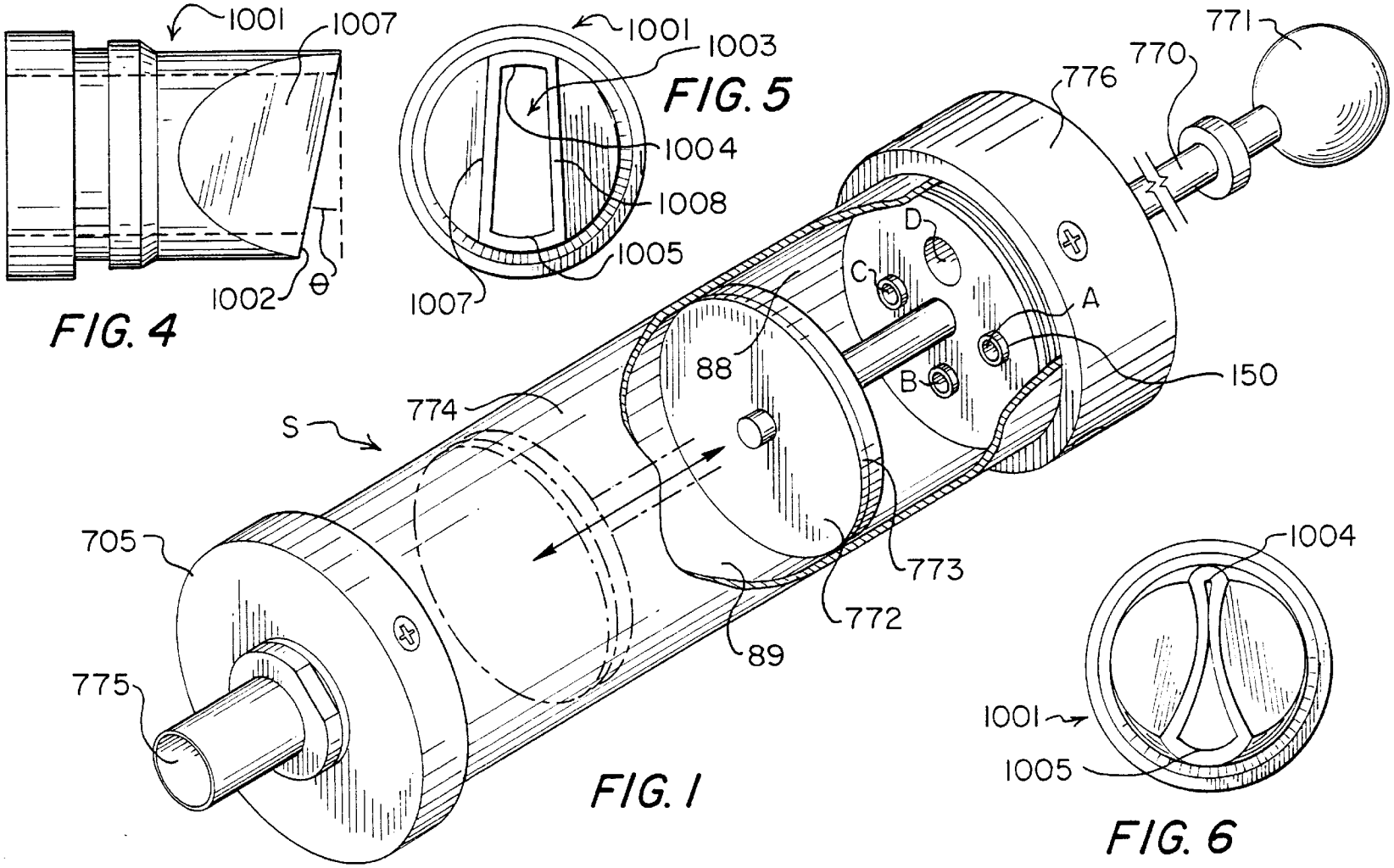
FIG. 1 is a top perspective view of the preferred embodiment shown in partial cut-away.
FIG. 4 is a side plan view of the preferred embodiment of the regulator valve shown in FIGS. 1, 2, 3.
FIG. 5 is a front plan view of the regulator valve of FIG. 4.
FIG. 6 is the same view as FIG. 5 but with the regulator valve orifice partially closed.
Figure 2:
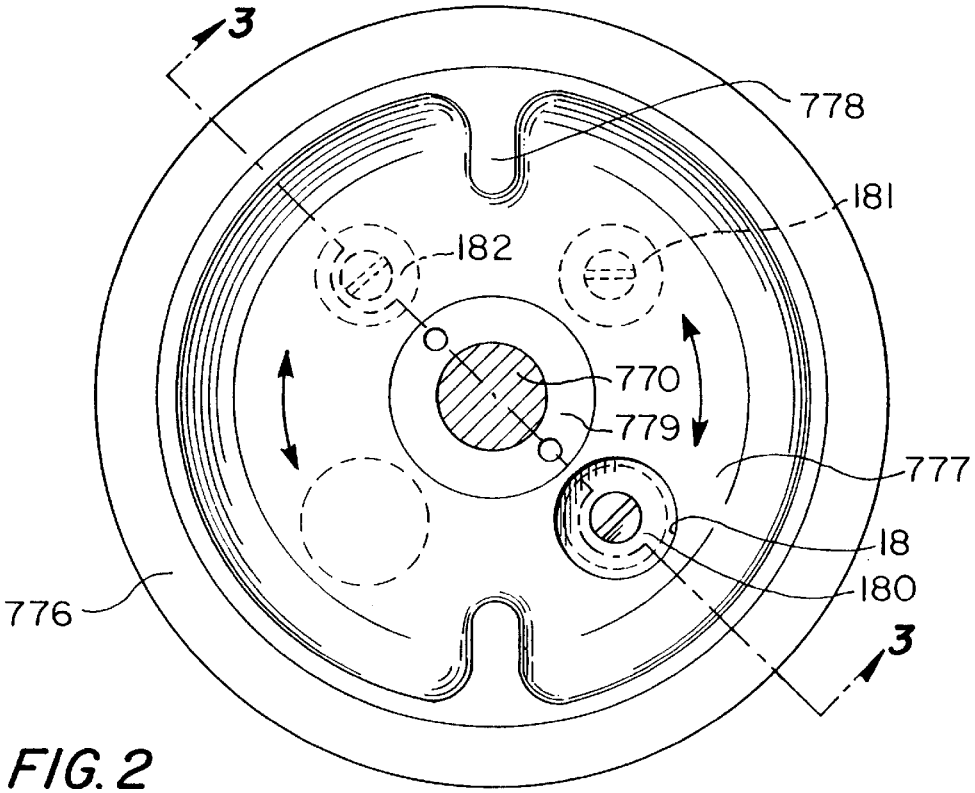
FIG. 2 is a front plan view of the valve selector of the preferred embodiment shown in FIG. 1.

Referring next to FIGS. 1, 2, 3 the preferred embodiment of the syringes S is shown. The syringe S is a single stage manual pump. The syringe operator (not shown) pushes on the handle 771 of the plunger 770 forcing the disk 772 in the OUTPUT direction as indicated in phantom. The disk 772 has a gasket 773 thereby separating chambers 88, 89 inside the syringe housing 774 in a known manner. Air flows into inlet 2 of port 18 and flows out the outlet port 775 of output manifold 705.

The collar 776 is an input manifold. It supports a selector disk 777 which has a single inlet port 18. Knob 778 enables rotation of selector disk 777 around hub 779. Positions 180, 181, 182 are solid to block the passage of air. In operation inlet port 18 is rotated to the desired collar port, A, B, C, or D. Collar port D has no regulator valve. Collar ports A, B, C have regulator valves for ½, 1, and 3 liters per minute. Thus, all ATS calibration tests can be done by simply selecting the appropriate collar port.

Referring next to FIGS. 4, 5, 6 detailed views of a preferred embodiment of regulator valve 1001 can be seen. Regulator valve 1001 is functionally equivalent to flexible regulator valve 1000, but experiments have shown that regulator valve 1001 performs slightly more linearly than flexible regulator valve 1000. Regulator valve 1001 has a tapered inlet edge 1002 as indicated by acute angle ⊖. The orifice 1003 is comprised of lips 1007, 1008. It has a narrow end 1004 and a wide end 1005. Pressure differentials cause the less resistant narrow end 1004 to close first as shown by FIG. 6.

Figure 17:
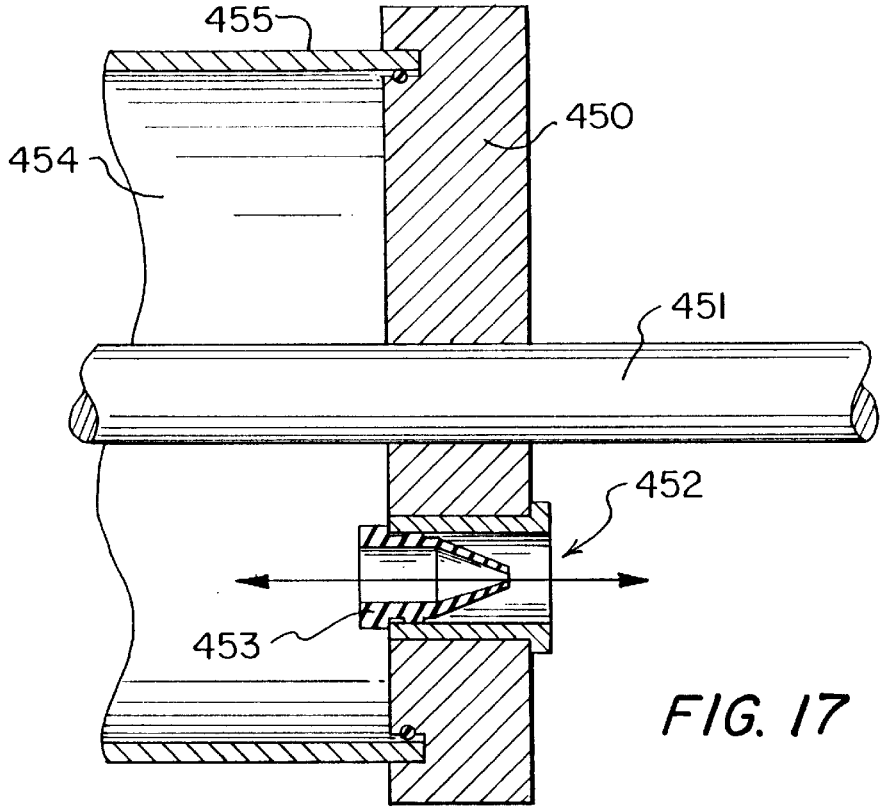
FIG. 17 is a sectional view of the front of an alternate embodiment of the syringe with only one regulator valve.
Figure 18:
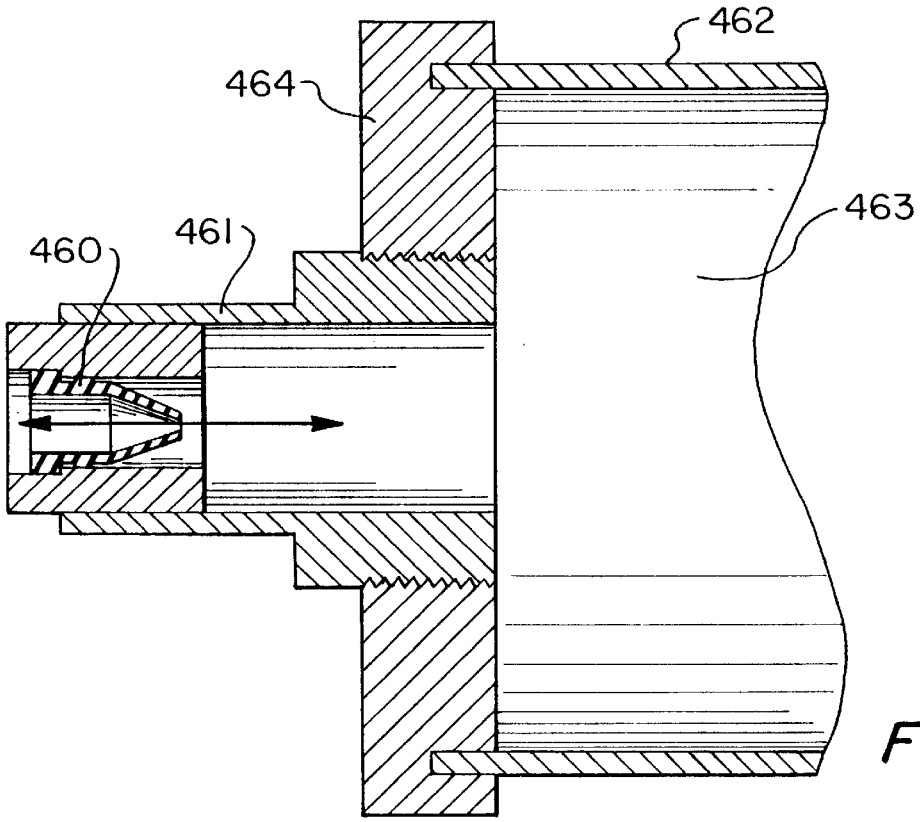
FIG. 18 is a sectional view of the back of an alternate embodiment of the syringe with a regulator valve at the output end.

The alternate embodiments shown in FIGS. 17, 18 function equivalently to the preferred embodiment described above. In FIG. 17 a syringe housing 455 is enclosed by a collar 450 having a single inlet port 452. The plunger 451 creates a vacuum in chamber 454 as noted above in the discussion of FIG. 1. The regulator valve 453 functions the same as regulator valve 1000 of FIG. 2.

Referring next to FIG. 18 the regulator valve 460 is placed in the outlet port 461. The syringe housing 462 is enclosed by the output manifold 464 thereby forming output chamber 463.

Figure 19:
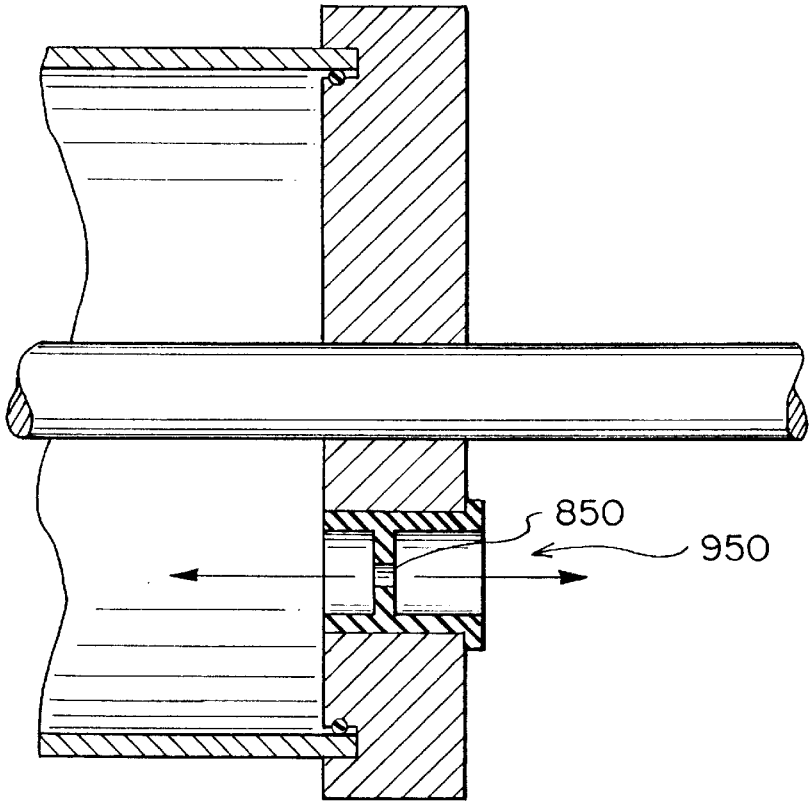
FIG. 19 is a sectional view of the front of an alternate embodiment having a fixed orifice in place of a regulator valve.
Figure 20:
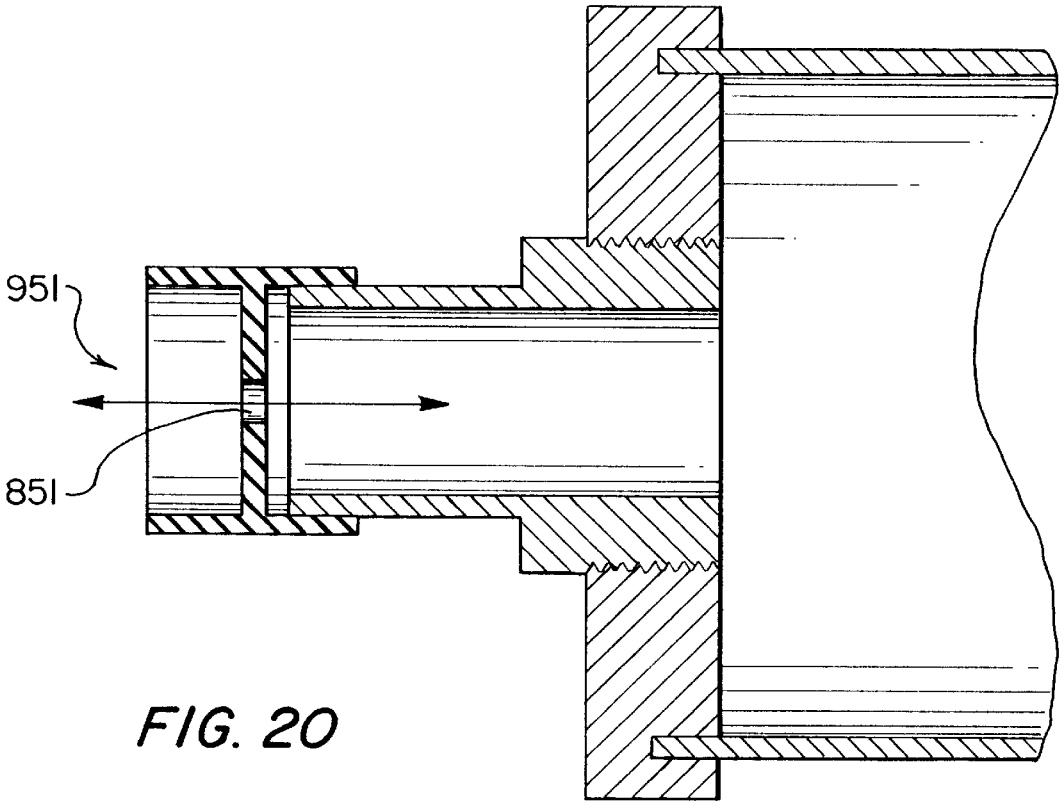
FIG. 20 is a sectional view of the output end of an alternate embodiment having a fixed orifice at the output end.

Referring next to FIGS. 19, 20 a different theory of operation is implemented by using fixed orifices 850, 851. FIG. 19 shows a fixed orifice in the inlet port 950. FIG. 20 shows a fixed orifice 851 in the outlet port 951. These embodiments require a fairly constant plunger force to operate.

Figure 21:
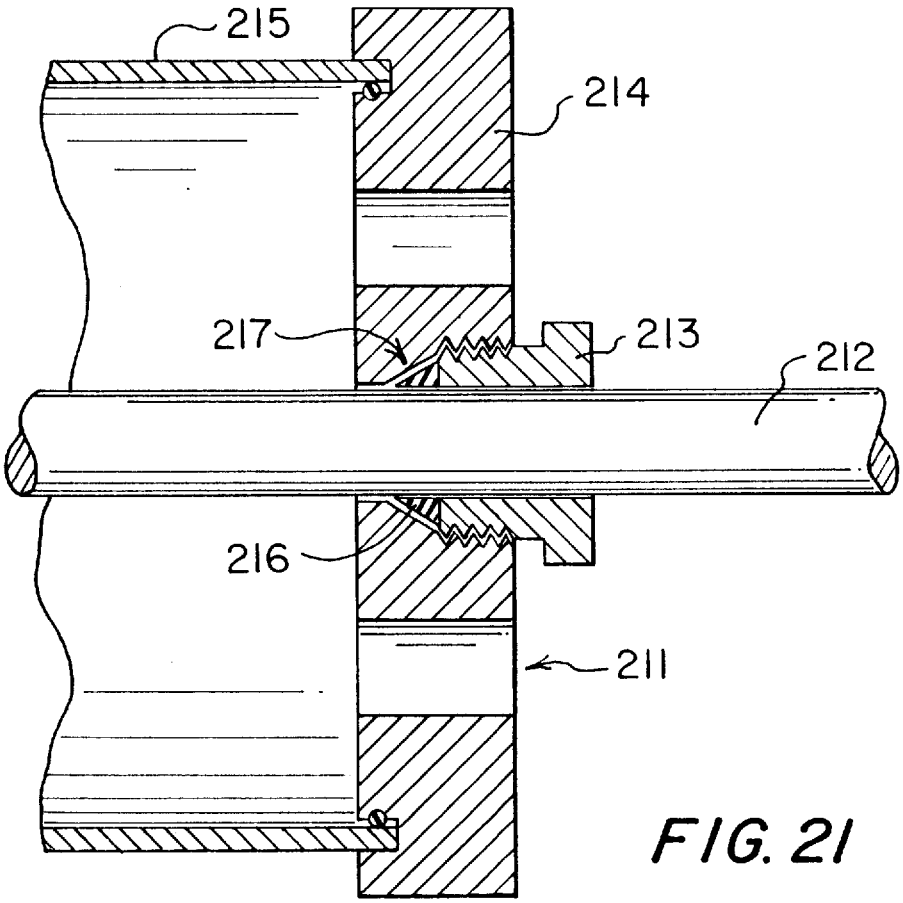
FIG. 21 is a sectional view of the front of an alternate embodiment having a friction wedge on the pump shaft.

Yet another theory of operation is implemented in FIG. 21. The syringe housing 215 has a collar 214 and inlet port 211. The plunger 212 slides through hub 213. Hub 213 can be tightened to squeeze nylon wedge 216 into ring groove 217 thereby causing friction on the plunger 212. The operator must apply a fairly constant plunger force to stabilize the plunger sliding rate and produce a fairly constant output flow.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A pump, comprising:

a pump housing comprising first and second chambers substantially isolated from each other;

a first port associated with said first chamber;

a first valve associated with said first port, wherein said first valve comprises a first flow orifice which is dynamically adjustable to vary a size of said first flow orifice;

a second port associated with said second chamber;

an adapter disposed on an exterior surface of said pump and extending beyond adjacent portions of said pump housing, said second port extending through said adapter; and means for simultaneously drawing a first fluid into said first chamber through said first port and valve and discharging a second fluid from said second chamber through said second port and said adapter, wherein a magnitude of force used by said means for simultaneously drawing and discharging affects said size of said first flow orifice, said size of said first flow orifice decreasing as said amount of said force increases, and wherein via said means for simultaneously drawing and discharging, said first fluid is drawn into said first chamber at the same time that said second fluid is discharged from said second chamber.

2. A pump, as claimed in claim 1, wherein:

said first and second fluids each consist essentially of air.

3. A pump, as claimed in claim 1, further comprising:

a piston movably received in said pump housing, wherein said first chamber is on a first side of said piston and said second chamber is on a second side of said piston.

4. A pump as claimed in claim 3, wherein:

said piston is vertically reciprocable within said pump housing, said pump further comprising a plunger interconnected with said piston.

5. A pump, as claimed in claim 1, wherein:

said first valve further comprises a second flow orifice displaced from said first flow orifice so that said means for simultaneously drawing and discharging first draws said first fluid through said first flow orifice and then through said second flow orifice into said first chamber, said second flow orifice being of a substantially fixed size.

6. A pump, as claimed in claim 5, wherein:

said size of said second flow orifice is larger than any said size of said first flow orifice.

7. A pump, as claimed in claim 1, wherein:

said first valve has a central, longitudinal axis, wherein at least part of an outer surface of said first valve tapers inwardly toward said central, longitudinal axis progressing away said first chamber.

8. A pump, as claimed in claim 1, wherein:

said first flow orifice is disposed on an end of said first valve, wherein an effective diameter of an outer surface of said first valve progressively increases progressing away from said first flow orifice for at least a portion of a length of said first valve.

9. A pump, as claimed in claim 1, wherein:

said first valve has a slot-like configuration from an end view of said first valve which is perpendicular to a direction of flow through said first valve, wherein a first end of said slot has a greater width than a second end of said slot opposite said first end.

10. A pump, as claimed in claim 1, wherein:

a width of said first flow orifice, taken perpendicularly to a direction of flow through said first flow orifice, varies based upon a distance from a central, longitudinal axis of said first valve.

11. A pump, as claimed in claim 1, wherein:

an end of said first valve comprises said first flow orifice, said first flow orifice having a generally rectangular profile when a pressure on an interior of said first valve is equal to a pressure on an exterior of said first valve.

12. A pump, as claimed 1, wherein:

when a pressure on an interior of said first valve is equal to a pressure on an exterior of said first valve, said size of said first flow orifice is greater than zero.

13. A pump, comprising:

a pump housing comprising first and second chambers substantially isolated from each other;

a first port associated with said first chamber;

a second port associated with said second chamber;

an adapter disposed on an exterior surface of said pump and extending beyond adjacent portions of said pump housing, said second port extending through said adapter;

a valve associated with said second port, wherein said valve comprises a first flow orifice which is dynamically adjustable to vary a size of said first flow orifice; and means for simultaneously drawing a first fluid into said first chamber through said first port and discharging a second fluid from said second chamber through said second port and said valve, wherein a magnitude of force used by said means for simultaneously drawing and discharging affects said size of said first flow orifice, said size of said first flow orifice decreasing as said amount of said force increases, and wherein via said means for simultaneously drawing and discharging, said first fluid is drawn into said first chamber at the same time that said second fluid is discharged from said second chamber.

14. A pump, as claimed in claim 13, wherein:

said first and second fluids each consist essentially of air.

15. A pump, as claimed in claim 13, further comprising:

a piston movably received in said pump housing, wherein said first chamber is on a first side of said piston and said second chamber is on a second side of said piston.

16. A pump as claimed in claim 15, wherein:

said piston is vertically reciprocable within said pump housing, said pump further comprising a plunger interconnected with said piston.

17. A pump, as claimed in claim 13, wherein:

said valve further comprises a second flow orifice displaced from said first flow orifice so that said means for simultaneously drawing and discharging first discharges said second fluid through said first flow orifice and then through said second flow orifice, said second flow orifice being of a substantially fixed size.

18. A pump, as claimed in claim 17, wherein:

said size of said second flow orifice is larger than any said size of said first flow orifice.

19. A pump, as claimed in claim 13, wherein:

said valve has a central, longitudinal axis, wherein at least part of an outer surface of said valve tapers outwardly from said central, longitudinal axis progressing away from said second chamber, and wherein said at least part of said outer surface of said valve is exposed to a pressure within said second chamber.

20. A pump, as claimed in claim 13, wherein:

said first flow orifice is disposed on an end of said valve, wherein an effective diameter of an outer surface of said valve progressively increases progressing away from said first flow orifice for at least a portion of a length of said valve.

21. A pump, as claimed in claim 13, wherein:

said first flow orifice is slot-like from an end view of said valve which is perpendicular to a direction of flow through said valve, wherein a first end of said slot has a greater width than a second end of said slot opposite said first end.

22. A pump, as claimed in claim 13, wherein:

a width of said first flow orifice, taken perpendicularly to a direction of flow through said first flow orifice, varies based upon a distance from a central, longitudinal axis of said valve.

23. A pump, as claimed in claim 13, wherein:

an end of said valve comprises said first flow orifice, said first flow orifice having a generally rectangular profile when a pressure on an interior of said valve is equal to a pressure on an exterior of said valve.

24. A pump, as claimed 13, wherein:

when a pressure on an interior of said valve is equal to a pressure on an exterior of said valve, said size of said first flow orifice is greater than zero.

25. A pump, comprising:

a pump housing comprising first and second chambers substantially isolated from each other;

a first port associated with said first chamber;

a first valve associated with said first port;

a second port associated with said first chamber;

a second valve associated with said second port;

a third port associated with said second chamber;

means for selectively blocking one of said first and second ports;

means for simultaneously drawing a first fluid into said first chamber through the open of said first and second ports and discharging a second fluid from said second chamber through said third port; and means for providing a fixed flow rate through said third port independent of an amount of force used by said means for simultaneously drawing and discharging and comprising said first and second valves, wherein said fixed flow rate has a first magnitude when only said first port is open and has a second magnitude, different from said first magnitude, when only said second port is open.

26. A pump, comprising:

a pump housing comprising first and second chambers substantially isolated from each other;

a first port associated with said first chamber;

a second port associated with said second chamber;

means for simultaneously drawing a first fluid into said first chamber through said first port and discharging a second fluid from said second chamber through said second port, said means for drawing and discharging comprising means for providing a substantially constant flow rate out of said second chamber regardless of a magnitude of a force used by said means for drawing and discharging, wherein via said means for simultaneously drawing and discharging, said first fluid is drawn into said first chamber at the same time that said second fluid is discharged from said second chamber.

27. A device for providing a substantially constant flow rate comprising:

a housing comprising first and second chambers substantially isolated from each other;

a first port associated with said first chamber;

a first valve associated with said first port, wherein said first valve comprises a first flow orifice which is dynamically adjustable to vary a size of said first flow orifice;

a second port associated with said second chamber; and means for simultaneously drawing a first fluid into said first chamber through said first valve and discharging a second fluid from said second chamber through said second port, wherein a magnitude of force used by said means for simultaneously drawing and discharging affects said size of said first flow orifice, said means for simultaneously drawing and discharging comprising means for providing a substantially constant flow rate out of said second chamber regardless of said magnitude of said force used by said means for simultaneously drawing and discharging.

28. A device, as claimed in claim 27, wherein said means for simultaneously drawing and discharging comprises:

a piston movably received in said housing, wherein said first chamber is on a first side of said piston and said second chamber is on a second side of said piston; and a plunger interconnected with said piston for moving said piston in said housing;

wherein said size of said first flow orifice of said first valve varies in relation to an amount of a force being exerted on said piston, said size of said first flow orifice decreasing as said amount of said force being exerted on said piston increases, whereby said substantially constant flow rate out of said second chamber is provided.

29. A device, as claimed in claim 27, wherein:

said first valve further comprises a second flow orifice displaced from said first flow orifice so that said means for simultaneously drawing and discharging first draws said first fluid through said first flow orifice and then through said second flow orifice into said first chamber, said second flow orifice being of a substantially fixed size.

30. A device, as claimed in claim 29, wherein:

said size of said second flow orifice is larger than any said size of said first flow orifice.

31. A device, as claimed in claim 27, wherein:

said first valve has a central, longitudinal axis, wherein at least part of an outer surface of said first valve tapers inwardly toward said central, longitudinal axis progressing away said first chamber.

32. A device, as claimed in claim 27, wherein:

said first flow orifice is disposed on an end of said first valve, wherein an effective diameter of an outer surface of said first valve progressively increases progressing away from said first flow orifice for at least a portion of a length of said first valve.

33. A device, as claimed in claim 27, wherein:

said first valve has a slot-like configuration from an end view of said first valve which is perpendicular to a direction of flow through said first valve, wherein a first end of said slot has a greater width than a second end of said slot opposite said first end.

34. A device, as claimed in claim 27, wherein:

a width of said first flow orifice, taken perpendicularly to a direction of flow through said first flow orifice, varies based upon a distance from said central, longitudinal axis of said first valve.

35. A device, as claimed in claim 27, wherein:

an end of said first valve comprises said first flow orifice, said first flow orifice having a generally rectangular profile when a pressure on an interior of said first valve is equal to a pressure on an exterior of said first valve.

36. A device, as claimed 27, wherein:

when a pressure on an interior of said first valve is equal to a pressure on an exterior of said first valve, said size of said first flow orifice is greater than zero.

37. A device for providing a substantially constant flow rate comprising:

a housing comprising first and second chambers substantially isolated from each other;

a first port associated with said first chamber;

a second port associated with said second chamber;

a valve associated with said second port, wherein said valve comprises a first flow orifice which is dynamically adjustable to vary a size of said first flow orifice; and means for simultaneously drawing a first fluid into said first chamber through said first port and discharging a second fluid from said second chamber through said second port and said valve, wherein a magnitude of force used by said means for simultaneously drawing and discharging affects said size of said first flow orifice, said means for simultaneously drawing and discharging comprising means for providing a substantially constant flow rate out of said second chamber regardless of said magnitude of said force used by said means for simultaneously drawing and discharging.

38. A calibration syringe, comprising:

a cylindrical housing comprising first and second chambers substantially isolated from each other;

a first port associated with said first chamber;

a first valve associated with said first port;

a second port associated with said first chamber;

a second valve associated with said second port;

a third port associated with said first chamber;

a third valve associated with said third port;

a fourth port associated with said second chamber;

means for selectively blocking all but one of said first, second and third ports;

means for simultaneously drawing a first fluid into said first chamber through the open one of said first, second and third ports and discharging a second fluid from said second chamber through said fourth port; and means for providing a fixed flow rate through said fourth port independent of an amount of force used by said means for simultaneously drawing and discharging and comprising said first, second and third valves, wherein said fixed flow rate has a first magnitude when only said first port is open, has a second magnitude when only said second port is open, and has a third magnitude when only said third port is open, said first, second and third magnitudes each being different from the others.

39. A syringe, as claimed in claim 38, wherein said means for simultaneously drawing and discharging comprises:

a piston movably received in said housing, wherein said first chamber is on a first side of said piston and said second chamber is on a second side of said piston; and a plunger interconnected with said piston for moving said piston in said housing.

* * * * *